US007866126B2

(12) United States Patent
Cadio

(10) Patent No.: US 7,866,126 B2
(45) Date of Patent: Jan. 11, 2011

(54) METHOD TO REDUCE THE PACKAGING FOAM BY USING EXTRA FOLDS IN THE CARTON

(75) Inventor: Michel Cadio, Carmel, IN (US)

(73) Assignee: TTE Technology, Inc., Indianapolis, IN (US)

( * ) Notice: Subject to any disclaimer, the term of this patent is extended or adjusted under 35 U.S.C. 154(b) by 711 days.

(21) Appl. No.: 11/771,649

(22) Filed: Jun. 29, 2007

(65) Prior Publication Data

US 2008/0251572 A1 Oct. 16, 2008

(30) Foreign Application Priority Data

Apr. 11, 2007 (CN) ..... 2007 1 0074009

(51) Int. Cl.
*B65B 23/00* (2006.01)
*B65D 81/113* (2006.01)

(52) U.S. Cl. ..... 53/472; 53/474; 206/320; 206/586

(58) Field of Classification Search ..... 53/445, 53/449, 458, 472, 474, 475, 139.5, 139.7; 206/320, 523, 576, 586; *B65D 81/113*
See application file for complete search history.

(56) References Cited

U.S. PATENT DOCUMENTS 3,137,980 A * 6/1964 Partridge ..... 53/139.5
3,416,648 A * 12/1968 Levi ..... 206/523
4,211,356 A * 7/1980 Tsuchiya et al. ..... 206/586
5,544,806 A * 8/1996 Anderson et al. ..... 206/586
5,692,618 A * 12/1997 Beak ..... 206/586
2002/0020653 A1* 2/2002 Davis ..... 206/549
2002/0139706 A1* 10/2002 Fujii ..... 206/523
2005/0087590 A1* 4/2005 Kawagoe et al. ..... 229/117.01
2007/0034548 A1* 2/2007 De Nola ..... 206/586

FOREIGN PATENT DOCUMENTS

DE 4030919 A1 * 4/1991
EP 509600 A1 * 10/1992
EP 601654 A1 * 6/1994
JP 08072857 A * 3/1996
JP 08244848 A * 9/1996
JP 2002211646 A * 7/2002
JP 2005145545 A * 6/2005
JP 2006117252 A * 5/2006

* cited by examiner

*Primary Examiner*—Stephen F Gerrity
(74) *Attorney, Agent, or Firm*—Shimokaji & Associates, P.C.

(57) ABSTRACT

A fold may be made in a conventional box which reduces the amount of packaging material necessary to secure an item in the box. Rear projection televisions may have a thick base and a thin top. Therefore, rectangular boxes may have much space at the top from the front of the box to the back of the box, in particular, when the television is in the carton, there may be substantial space between the back of the top of the television to the back panel of the carton. Typically, packaging material is placed in this space. By placing a fold in the carton along the portion of the box where this packaging material may conventionally extend, the amount of packaging material may be reduced by abutting the packaging material to the fold in the carton instead of the back panel of the carton.

10 Claims, 6 Drawing Sheets

METHOD TO REDUCE THE PACKAGING FOAM BY USING EXTRA FOLDS IN THE CARTON

CROSS-REFERENCE TO RELATED APPLICATIONS

This application claims foreign priority under 35 USC 119(a)-(d) to Chinese Patent Application 200710074009.7, filed on Apr. 11, 2007, the disclosure of which is herein incorporated by reference in its entirety.

BACKGROUND OF THE INVENTION

The present invention relates to an apparatus and method to reduce the amount of packaging required to protect contents in a carton, and more specifically to an apparatus and method to reduce the needed amount of packaging foam in a carton by providing extra folds in the carton.

Referring to FIG. 1, there is shown a side cross-sectional view of a conventional television, such as a rear projection television 10 which may use EPS foam blocks 12 in a carton 14 to protect the television 10 during transportation. Newer models of rear projection televisions 10 have a thick base 16 (thick referring to the dimensions from the front of the television to the back of the television) and a very thin top 18 (again, as measured from the front of the television 10*a* to the back of the television 10*b*). Generally, in order to protect the television 10, the corners 20 of the television are provided with foam blocks 12 which fit from a front 14*a* to a back 14*b* of the carton 14.

With the above described conventional packaging system, large blocks of foam 12 may be needed between a back 10*b* of the television 10 to the back 14*b* of the carton 14. Due to their size, these large pieces of foam 12 may be expensive and add significant weight to the contents of the carton 14.

Japanese Patent Publication 2006-117252 discloses a packing material capable of fixing a position of a television receiver with a decrease in the number of cushioning materials. The top flap that is on the back of the box (the back being the side opposite the side that the television screen is facing when inside the box) has a fold on an end portion thereof. When the top flap is folded into the box, his folded portion provides a stop wherein cushioning may only be needed from the top of the television to the folded portion of the back flap. This design, however, may not provide adequate support to hold the cushioning material in place. Additionally, this flap is required to be folded into the box first (because of the lip that is to support the cushioning material) and, therefore, may be capable of being folded further than at a 90 degree angle with the side of the box. Such a fold may shorten the length from the back of the box to the fold which, in turn, may create a space between the cushioning material and the fold in the flap, thereby allowing the television to move inside the box.

Japanese Patent Publication 2002-211646 discloses another method of using less cushioning material inside a box for packaging televisions. This invention provides a box that has the back corners folded inward (see FIGS. 4-9). With the back corners folded inward, the distance from the top of the television to the back of the box is shortened, thereby allowing for a shorter piece of cushioning material to secure the television in the box. This design, however, requires a box having many additional folds in its manufacture. Additionally, this design results in a box having a non-rectangular footprint, thereby potentially making stacking, shipping, storing and the like less stable.

As can be seen, there is a need for an apparatus and method for reducing packaging form in a carton that can be easily manufactured, easily handled, and secures the contents therein without compromising the strength of the carton.

SUMMARY OF THE INVENTION

In one aspect of the present invention, a carton comprises a first side panel having a first side flap attached thereto; and two first side panel slits formed orthogonal to and extending across a first closure fold between the first side panel and the first side flap.

In another aspect of the present invention a method for packaging an item comprises creating a first fold in a carton by pressing in a first region between a first set of two slits toward an inside volume of the carton while folding a first side panel over the carton; and securing at least one portion of the item with a first piece of packaging material, the first piece of packaging material being secured between a front panel of the carton and the first fold in the carton.

According to a further aspect of the present invention, a method for securing an item in a carton comprises providing a carton having a first side panel with a first side flap and a second side panel having a second side flap; forming a first fold from a portion of the first side panel and the first side flap, and a second fold from a portion of the second side panel and the second side flap; pressing the first fold and the second fold so that they extend into an inside volume of the carton; and securing the item with packaging material extending from a front panel of the carton to the fold.

These and other features, aspects and advantages of the present invention will become better understood with reference to the following drawings, description and claims.

DETAILED DESCRIPTION OF THE INVENTION

Figure 1:
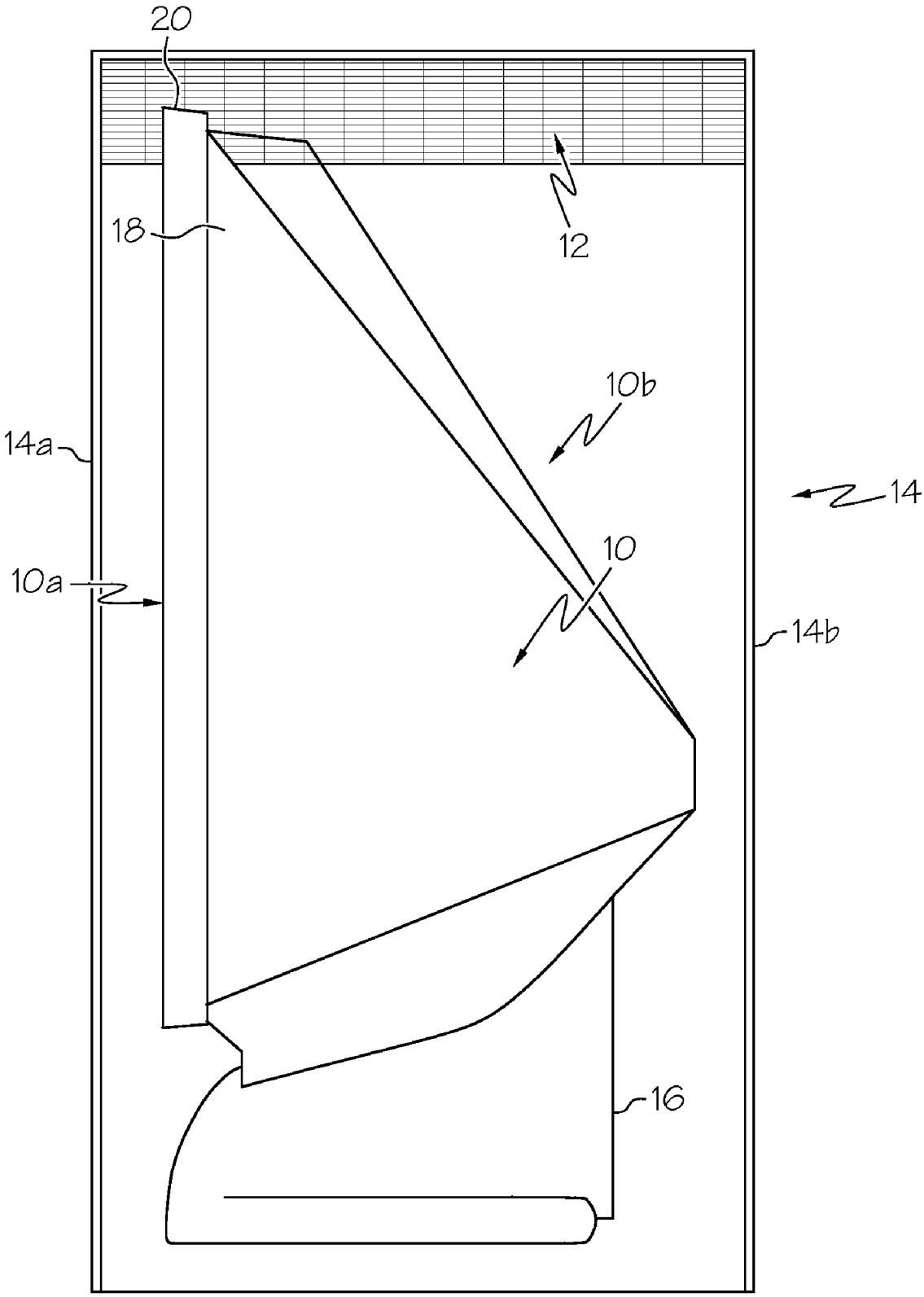
FIG. 1 (PRIOR ART)
FIG. 1 is a cross-sectional drawing showing a television in a carton using a conventional design.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The term "carton" as used herein refers to any container for packaging an item therein. For example, a carton may be used for packaging a television therein for shipping to a remote location. A carton may be made from any material, including as examples, corrugated cardboard, polymers including high density plastics, and the like.

The term "flap" as used herein refers to a top or bottom portion of a carton that may be folded toward the inside of the carton to cover the contents therein. Conventional cardboard boxes, for example, may have four flaps on the top which may fold at 90 degree angles with each side of the box towards the inside of the box to cover the contents therein.

The term "orthogonal" as used herein refers to a first item having a directional characteristic that is about 90 degrees offset from a directional characteristic of a second object. The term orthogonal is not meant as an absolute measure, but rather to mean a measure of about 90 degrees within, for example, manufacturing limitations of up to about 5 degrees.

Briefly, the present invention provides an apparatus and method for packaging an item which may not occupy the entire contents of the carton, thereby requiring packaging material to be inserted to secure the item inside the carton. For example, the present invention provides in one embodiment a carton for packaging a rear projection television therein. The base of the rear projection television may be large in comparison to the smaller top. In a conventional carton, when placing the television in a rectangular box (rectangular so as not to require any complicated manufacturing techniques and also to provide for easy handling, storing, shipping and the like), the top interior portion of the carton may have significant spaces between the television and the sides of the carton. Unlike conventional packaging designs that may require a large piece of packaging to fill these significant spaces at the top interior portion of the carton, the present invention may provide a fold in the carton to allow for less packaging while still adequately securing the television in the carton.

An advantage of the present invention is that the carton used for packaging according to the present invention may be the same carton as is conventionally used for packaging televisions. By forming cuts in the conventional carton to create a fold, the benefits of the carton of the present invention may be realized. The carton of the present invention may result in cost savings in that the cost and weight of the packaging material may be reduced while not requiring a large change to a conventional carton design.

While the discussion below may be focused on packaging a rear projection television in a carton, the present invention may include further embodiments embraced therein. The present invention may be useful in providing a packaging carton that uses less packaging material in any number of packaging situations where the object to be packaged may have one end that may have a different thickness in comparison to another end. For example, a stove may have a relatively thin back panel extending from a large rectangular base and therefore may be packaged using less packaging material in accordance with the present invention.

Figure 2:
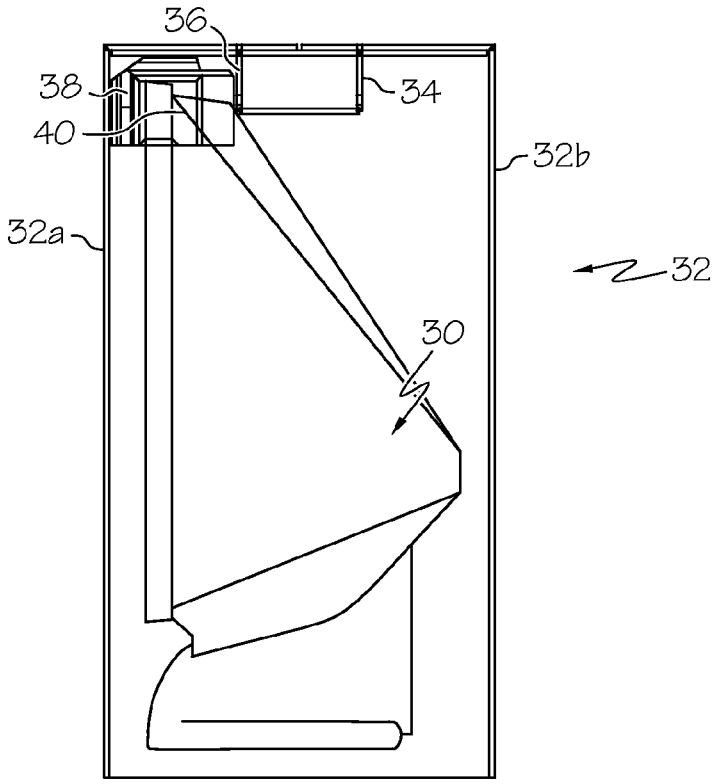
FIG. 2 is a cross-sectional drawing showing a television in a carton according to an embodiment of the present invention.

Referring to FIG. 2, there is shown a cross-sectional view of a carton 32 according to an embodiment of the present invention, with a television 30 therein. The carton 32 may have a foam securing fold 34 therein (as will be described in more detail below with respect to additional drawings). The fold 34 may create an abutment 36 against which a packaging material 38 (which may secure a top corner 40 of the television 30) may abut. In other words, instead of having the packaging material 38 secure the top corner 40 of the television 30 by running from a front 32*a* of the carton to a back 32*b* of the carton as in a conventional design, the packaging material 38 may only need to run from the front 32*a* of the carton to the abutment 36 where the packaging material 38 contacts the fold 34.

Figure 3:
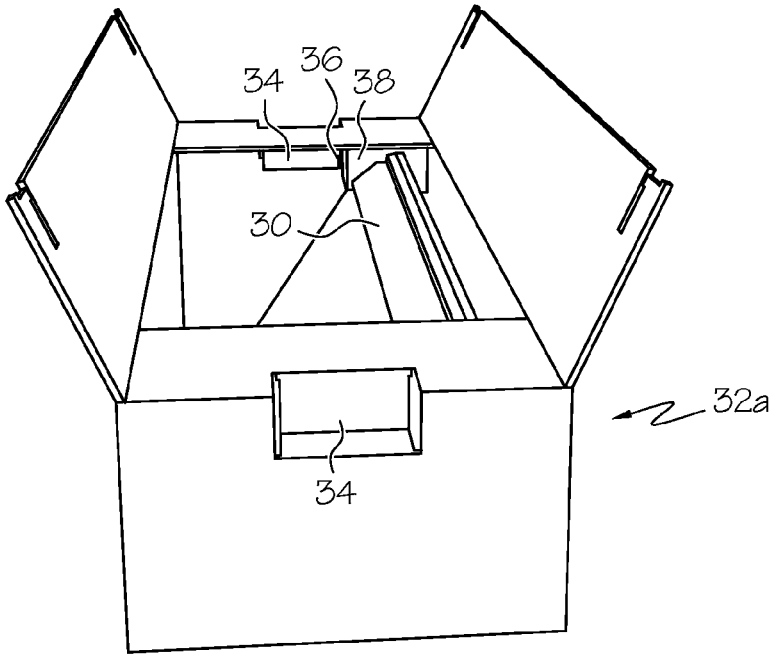
FIG. 3 is a perspective view of the television of FIG. 2 packed inside a carton.

Referring now to FIG. 3, there is shown a perspective view of the carton 32 as described above with reference to FIG. 2 and having the television 30 packed therein. As can be seen and as was discussed above, the packaging material 38 may contact the abutment 36 at the fold 34. This configuration may save cost and weight of the packaging material 38 for the television 30 while still securing the television 30 inside the carton 32. The cost and weight savings may be realized by using less packaging material 38. For example, a weight savings of from about 0.5 pounds to about 2 pounds may be realized when packaging a television 30 according to the present invention as compared to packaging a television according to conventional methods.

Figure 4A:
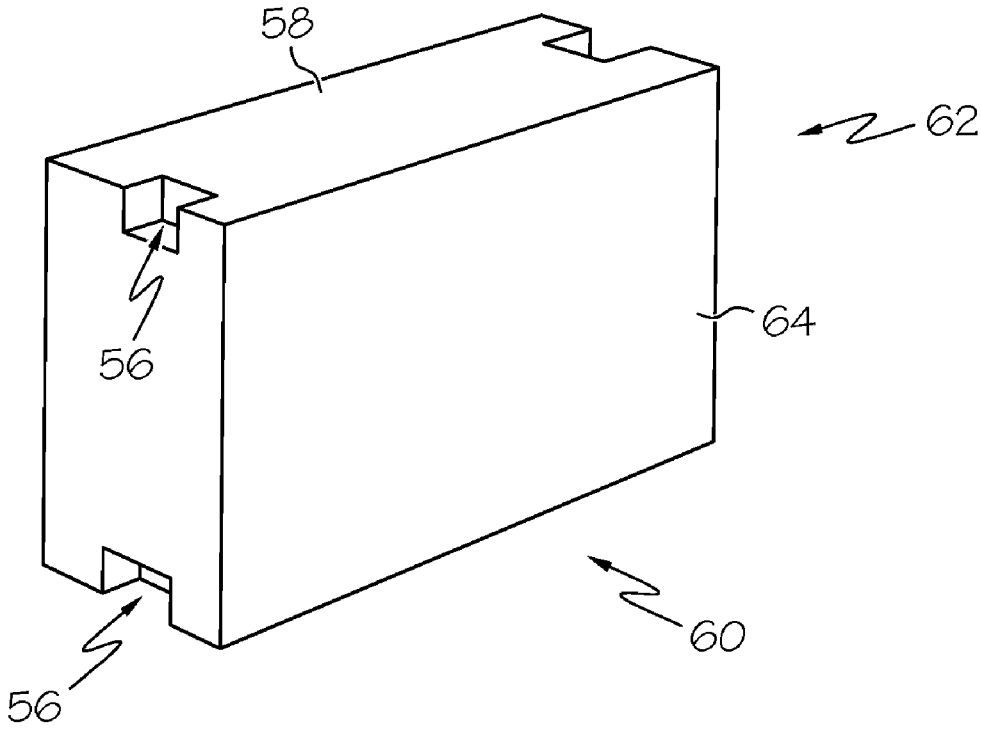
FIGS. 4A and 4B are perspective views showing another embodiment of the present invention.
Figure 4B:
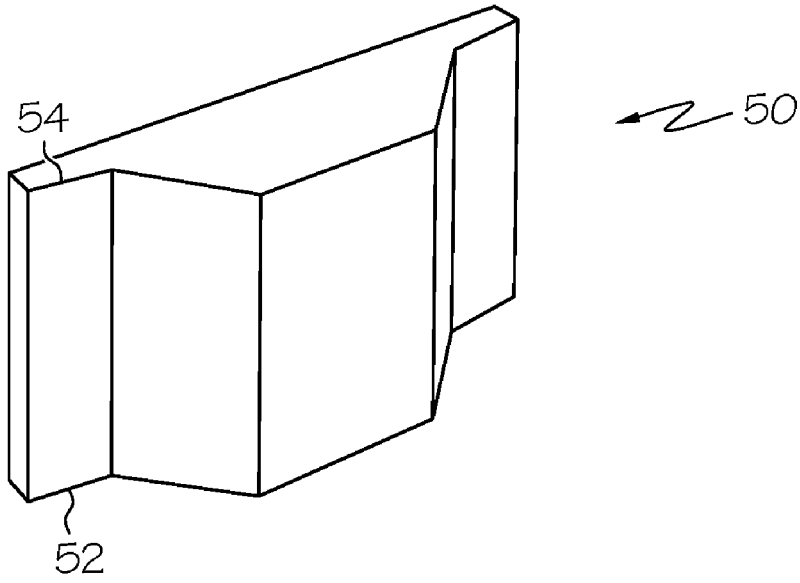

Referring to FIGS. 4A and 4B, there is shown an alternate embodiment of the present invention. When an item 50 has a base 52 having a similar profile as its top 54, folds 56 may be created both on the top 58 and bottom 60 of the carton 62. Similar to the above embodiment where a packaging material (not shown) may be reduced because the packaging material is only needed to run from the item 50 to the fold 56 (as compared to conventional cartons, wherein the packaging material may be needed to run from the item 50 to an opposite side 64 of the carton), this embodiment of the present invention may also reduce the packaging material (and therefore the weight) used to pack the item 50 in the carton 62.

Referring to FIGS. 5A through 5E there are shown, in a pictorial fashion, steps involved in a method 100 for packaging an item, such as television 30, according to the present invention. Similarly, FIG. 6 is a flow chart depicting the steps of method 100.

Figure 5A:
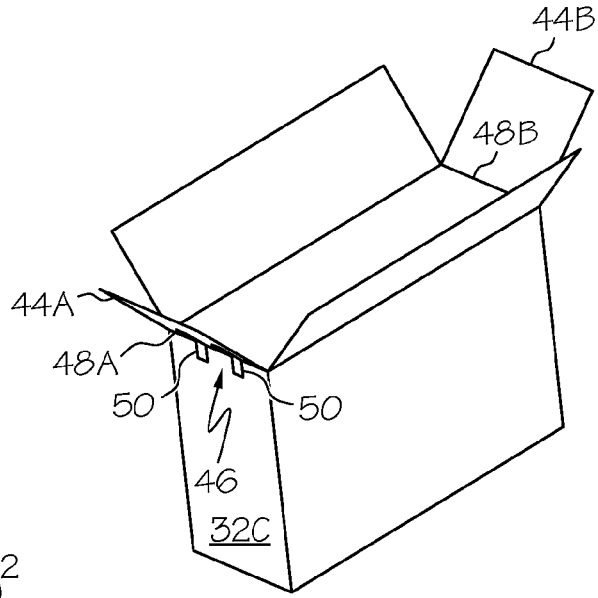
FIGS. 5A-5E are pictorial views of steps of a method according to an embodiment of the present invention.
Figure 6:
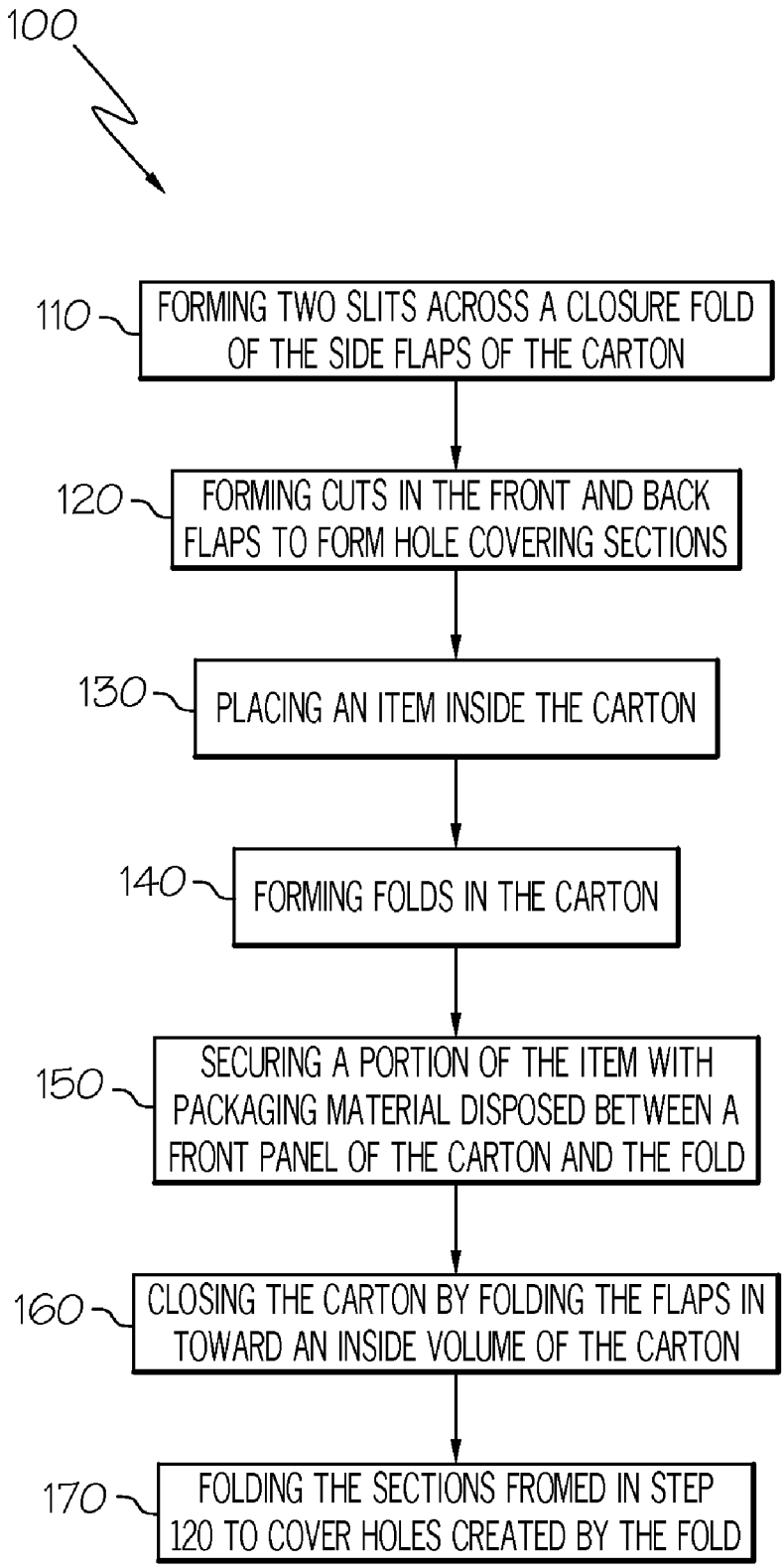
FIG. 6 is a flow chart describing the method shown in FIGS. 4A-4E.

Referring now to FIGS. 5A and 6, a method 100 for securing an item inside a carton 32 may include a step 110 of cutting two slits 46 across a first closure fold 48*a* and a second closure fold 48*b* where side flaps 44*a*, 44*b* may fold along a side panel 32*c* of the carton 32. More specifically, first closure fold 48*a* may be formed by side flap 44*a* and second closure fold 48*b* may be formed by side flap 44*b*. The slits 46 may be formed orthogonal to the closure folds 48*a*, 48*b*. In one embodiment of the present invention, the slits 46 may be formed in a central region 35 of the side flaps 44*a*, 44*b*.

An optional step 120 of cutting cuts 42 in the front and back flaps 60, 62 of the carton 32 may be performed prior to placing the television 30 into the carton 32. The cuts 42 may result in creating a section 54 that may be folded to cover holes 56, as described in more detail below with respect to step 170. An item, such as a television 30 may be placed inside of the carton 32 in a step 130.

Figure 5B:
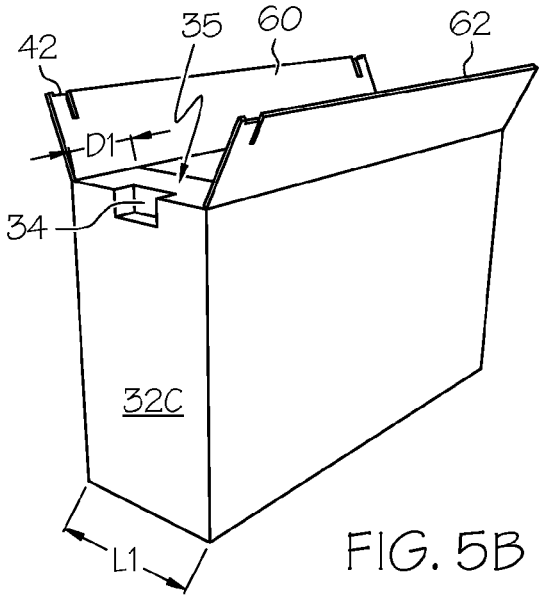

Referring to FIGS. 5B and 6, the fold 34 may be formed in a step 140 of pressing a region 50 in between the slits 46 formed in each of the side flaps 44*a*, 44*b* toward an inside volume 52 of the carton 32 as each of the side flaps 44*a*, 44*b* are folded in towards the inside volume 52 of the carton 32. By centrally locating the fold 34 along the side panel 32*c*, the carton 32 can be used without regard to the front 32*a* or back 32*b* thereof. In other words, when the fold 34 is centrally located along the side panel 32*c* of the carton 32, there would be no requirement as to which direction the television 30 may be placed inside the carton 32 (with respect to the front 30*a* and the back 30*b* of the television).

While the fold 34 occupies about one-third of the side panel 32*c* of the carton 32, the length L and depth D of the fold 34 may be selected based on certain criteria. For example, the fold 34 should be strong enough to secure the contents (that is, the fold 34 must not collapse when the carton 32 is moved, thereby securing the packaging material 38 and the television 30). However, the fold 34 should not be too large for risk of weakening the strength of the carton 32 (and therefore reducing, for example, the ability to stack cartons 32 on top of one another). Typically, the length L of the fold 34 may be from about 10% to about 50% of the length L1 of the side panel 32*c*. The depth D of the fold 34 may be from about 10% to about 50% of the depth Dl of the side flap 44. This percentage can be modified depending on material strength and carton size.

Figure 5C:
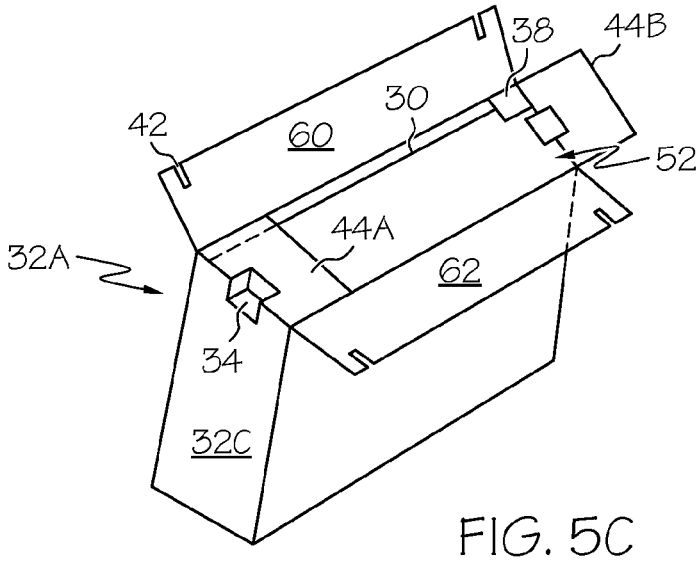

Referring to FIGS. 5C and 6, the method 100 may include a step 150 of securing at least one portion of the television 30 with a first piece of packaging material 38, the packaging material 38 being secured between a front panel 32*a* of the carton 32 and the first fold 34 in the carton 32.

Figure 5D:
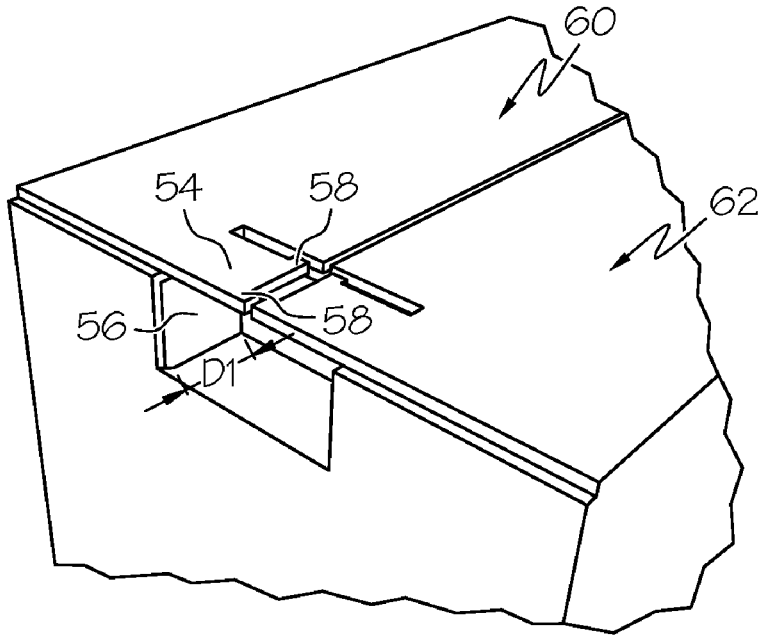

Referring now to FIGS. 5D and 6, after the side flaps 44*a*, 44*b* are folded in towards the inside volume 52 of the carton 32, thereby creating an angle of about 90 degrees with the side panel 32*c*, a step 160 of folding the front flap 60 and the back flap 62 in towards the inside volume 52 of the carton 32 may result in covering the inside volume 52 with flaps 44*a*, 44*b*, 60, 62.

Figure 5E:
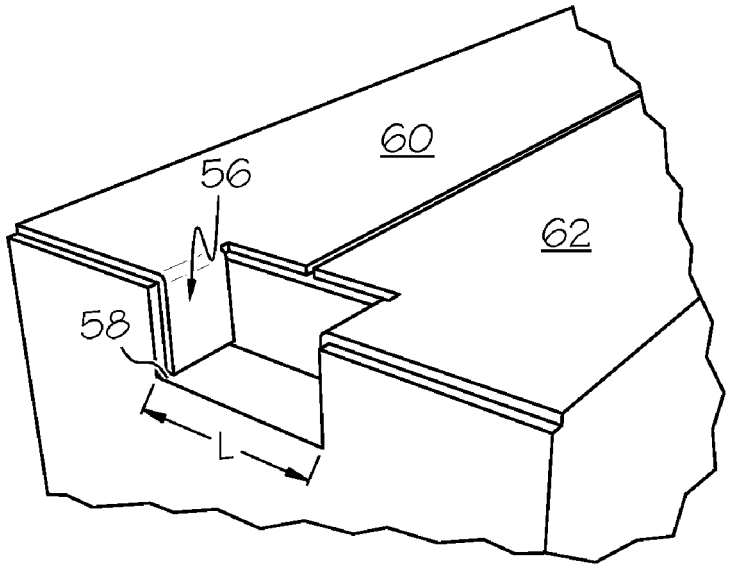

Referring to FIGS. 5E and 6, an optional step 170 of folding the sections 54, as described above with reference to step 120, into the fold 34 may cover holes 56 created on each side of the fold. The sections 54 of the front and back flaps 60, 62 that are folded to cover the holes 56 may be formed with protrusions 58 as shown in FIG. 5D. These protrusions 58 may be sized to provide a means of securing the section 54 when folded to cover the holes 56. As shown in FIGS. 5D, 5E and 6, in optional step 170, the protrusions 58 may fit inside of the each of the holes 56 on each side of the fold 34 while the section 54 covers each of the holes 56 created on each side of the fold 34. Other means may be used to secure the sections 54 to cover the holes 56. For example, packaging tape may be used to secure the sections 54 at the same time that the front and back flaps 60, 62 are secured.

While the present invention is described as securing a television in a carton by having folds made on the sides of the carton, the invention is not meant to be limited by this particular example. As discussed above, any object may be secured in the carton where there may be space between the object and an inside portion of the carton, thereby requiring packaging material to be placed to fill that space. Moreover, depending on the item packaged in the carton and the requirements to secure the item with packaging material, folds may be cut in the front and back of the carton (in addition to, or in replacement of, the sides, as described in the above example). Front and back side folds may be useful when packaging material is needed to run the length of the front or back of the carton.

It should be understood, of course, that the foregoing relates to exemplary embodiments of the invention and that modifications may be made without departing from the spirit and scope of the invention as set forth in the following claims.

I claim:

1. A method for packaging an item, the method comprising:

creating a first fold in a carton by pressing in a first region, between a first set of two slits, toward an inside volume of the carton while folding a first side flap over the carton;

creating a second fold in the carton by pressing in a second region, between a second set of two slits, toward the inside volume of the carton while folding a second side flap over the carton;

securing at least one portion of the item with a first piece of packaging material, the first piece of packaging material being secured between a front panel of the carton and the first fold in the carton; and securing at least another portion of the item with a second piece of packaging material, the second piece of packaging material being secured between the front panel of the carton and the second fold in the carton, wherein:

a length of the first and second folds may be from about 10% to about 50% of a length of the first and second side flaps, respectively; and a depth of the first and second folds may be from about 10% to about 50% of a depth of the first and second side flaps, respectively.

2. The method according to claim 1, further comprising covering holes formed by the first fold with a section from a front flap and a back flap of the carton.

3. The method according to claim 1, wherein the first set of two slits is centrally located along the first side flap.

4. The method according to claim 1, wherein said item is a rear projection television.

5. The method according to claim 1, wherein the carton is made of corrugated cardboard.

6. A method for securing an item in a carton, the method comprising:

providing a carton having a first side panel with a first side flap and a second side panel having a second side flap;

forming a first set of two slits orthogonal to and extending across a first closure fold between the first side panel and the first side flap;

forming a second set of two slits orthogonal to and extending across a second closure fold between the second side panel and the second side flap;

creating a first fold in the carton by pushing a first region, between the first set of two slits, toward an inside of the carton while folding the first side flap over the carton;

creating a second fold in the carton by pushing a second region, between the second set of two slits, toward an inside of the carton while folding the second side flap over the carton;

pressing the first fold and the second fold so that they extend into an inside volume of the carton; and securing the item with a first packaging material extending from a front panel of the carton to the first fold and a second packaging material extending from the front panel of the carton to the second fold.

7. The method according to claim 6, further comprising:

forming at least one front flap slit in the front flap attached to the front panel of the carton;

forming at least one back flap slit in a back flap attached to a back panel of the carton;

folding a first section of the front and back flaps formed by the front and back flap slits to cover a first hole formed when the region between the first set of slits is pressed in to form the first fold when the first side flap is folded over the carton; and folding a second section of the front and back flaps formed by the front and back flap slits to cover a second hole formed when the region between the second set of slits is pressed in to form the second fold when the second side flap is folded over the carton.

8. The method according to claim 6, wherein:

a length of the first and second folds may be from about 10% to about 50% of a length of the first and second side flaps, respectively; and a depth of the first and second folds may be from about 10% to about 50% of a depth of the first and second side flaps, respectively.

9. The method according to claim 6, wherein the carton is made of corrugated cardboard.

10. The method according to claim 6, wherein the item is a rear projection television.

* * * * *